US011590396B2

(12) United States Patent
Derkevics

(10) Patent No.: US 11,590,396 B2
(45) Date of Patent: Feb. 28, 2023

(54) BASEBALL BAT SWING TRAINING ASSEMBLY AND METHOD

(71) Applicant: Jason Derkevics, Chaska, MN (US)

(72) Inventor: Jason Derkevics, Chaska, MN (US)

( * ) Notice: Subject to any disclaimer, the term of this patent is extended or adjusted under 35 U.S.C. 154(b) by 196 days.

(21) Appl. No.: 16/533,087

(22) Filed: Aug. 6, 2019

(65) Prior Publication Data

US 2021/0038959 A1 Feb. 11, 2021

(51) Int. Cl.
*A63B 69/00* (2006.01)

(52) U.S. Cl.
CPC ..... *A63B 69/0059* (2013.01); *A63B 69/0002* (2013.01); *A63B 69/0062* (2020.08); *A63B 2069/0008* (2013.01)

(58) Field of Classification Search
CPC ..... A63B 69/36; A63B 69/0059
See application file for complete search history.

(56) References Cited

U.S. PATENT DOCUMENTS 4,867,488 A 9/1989 Jones
5,114,142 A 5/1992 Gillespie
5,704,856 A * 1/1998 Morse ..... A63B 69/0002 473/212
5,954,598 A 9/1999 Carlson
6,755,755 B2 6/2004 Wah Loh
6,773,366 B2 8/2004 Gray
6,918,844 B2 7/2005 Socci
7,731,597 B1 * 6/2010 Burgess ..... A63B 69/36212 473/215
7,811,185 B1 10/2010 Reynolds
9,017,182 B1 * 4/2015 Freiler, Jr. ..... A63B 69/3608 473/213
9,440,131 B2 9/2016 Mueller
2004/0076939 A1 4/2004 Socci
2007/0232404 A1 * 10/2007 Begert ..... A63B 69/0059 473/216
2008/0085789 A1 4/2008 Molley
2009/0227384 A1 * 9/2009 Reynolds ..... A63B 69/0057 473/207
2010/0041499 A1 2/2010 Reynolds
2011/0165955 A1 * 7/2011 Moore ..... A63B 69/3608 473/215

* cited by examiner

*Primary Examiner* — Eugene L Kim
*Assistant Examiner* — Christopher Glenn

(57) ABSTRACT

A baseball bat swing training method includes the steps of attaching a leg coupler to a lead leg of a batter adjacent to a knee of the batter. The leg coupler is configured to be extendable around the lead leg. A baseball bat is provided having a grip terminating with a knob. A tether is attached to the baseball bat grip adjacent to the knob. The tether is attached to the leg coupler. The tether includes a resiliently stretchable area and an area resistant to stretching. A length of the tether is adjusted such that the tether is taut as the batter is positioned in a set position before the batter moves toward a batting swing load position. Resistance to stretching of the tether increases as the batter moves to the batting swing load position.

8 Claims, 5 Drawing Sheets

BASEBALL BAT SWING TRAINING ASSEMBLY AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to baseball swing teaching assist device and more particularly pertains to a new baseball swing teaching assist device for teaching a person muscle memory as they move from a set position, through a load position and into a swing.

(2) Description of Related Art Including Information Disclosed Under 37 CFR 1.97 and 1.98

The prior art relates to baseball swing teaching assist devices that are attachable to a person so as to direct the person through a swing. Prior art devices, however, tend to attach to the person and do not properly create a pulling on the baseball bat for the purpose of enhancing muscle memory throughout a baseball bat swing.

BRIEF SUMMARY OF THE INVENTION

An embodiment of the disclosure meets the needs presented above by generally including the steps of attaching a leg coupler to a lead leg of a batter adjacent to a knee of the batter. The leg coupler is configured to be extendable around the lead leg. A baseball bat is provided having a grip terminating with a knob. A tether is attached to the baseball bat grip adjacent to the knob. The tether is attached to the leg coupler. The tether includes a resiliently stretchable area and an area resistant to stretching. A length of the tether is adjusted such that the tether is taut as the batter is positioned in a set position before the batter moves toward a batting swing load position. Resistance to stretching of the tether increases as the batter moves to the batting swing load position.

Another embodiment of the disclosure includes a leg coupler configured to be attached to a lead leg of a batter adjacent to a knee of the batter. The leg coupler is configured to be extendable around the lead leg. A tether is provided which is configured to be attached to a baseball bat grip adjacent to the knob. The tether is attached to the leg coupler. An attachment point between the tether and the leg coupler is movable on the leg coupler. The tether has an adjustable length and includes a resiliently stretchable area and an area resistant to stretching. A length of the tether is adjusted such that the tether is taut when a batter is positioned in a set position. The assembly is configured to increase resistance to stretching of the tether as the batter moves to a batting swing load position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
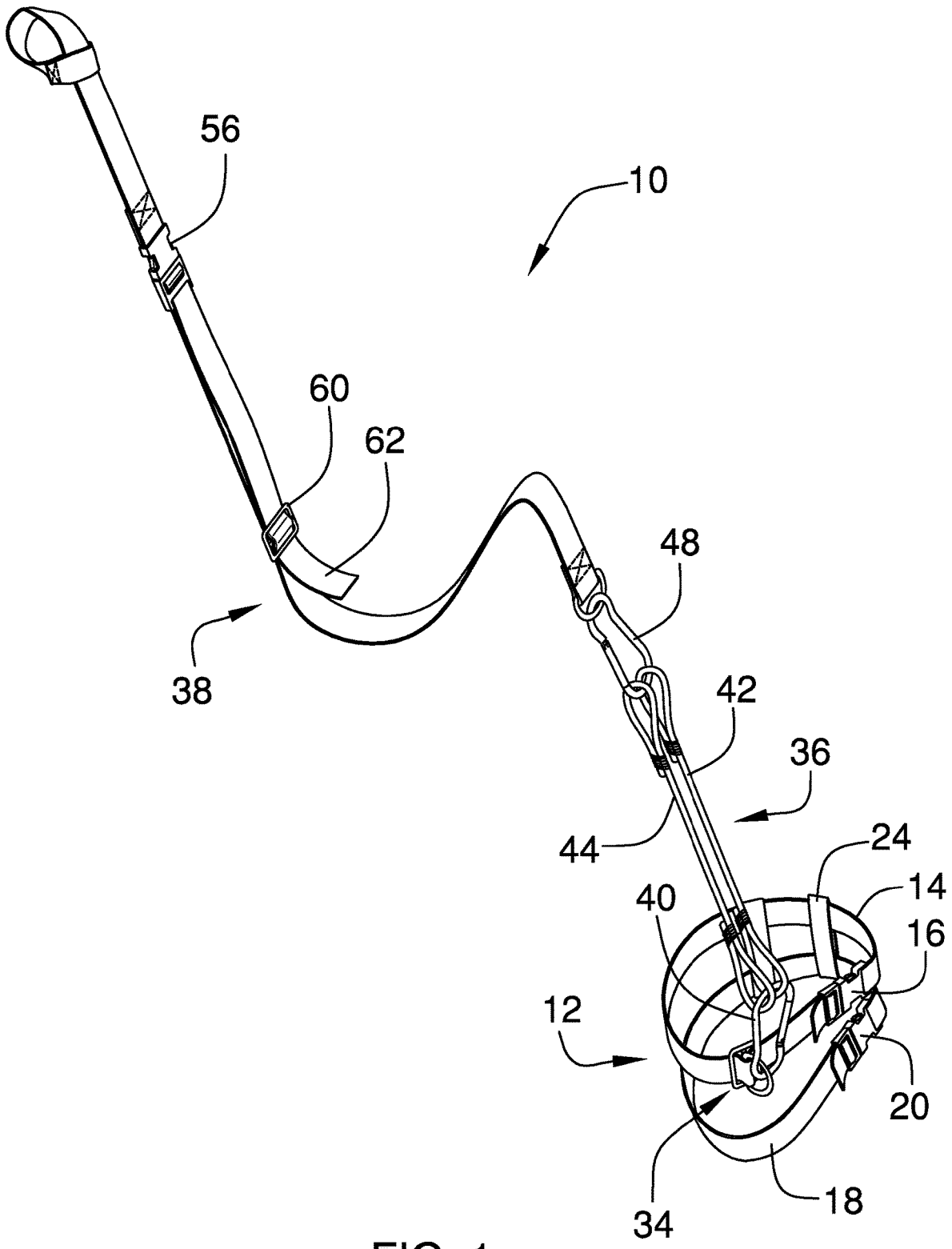
FIG. 1 is an isometric view of a baseball bat swing training assembly and method according to an embodiment of the disclosure.

With reference now to the drawings, and in particular to FIGS. 1 through 5 thereof, a new baseball swing teaching assist device embodying the principles and concepts of an embodiment of the disclosure and generally designated by the reference numeral 10 will be described.

As best illustrated in FIGS. 1 through 5, the baseball bat swing training assembly and method 10 generally comprises attaching a leg coupler 12 to a lead leg 72 of a batter 70 adjacent to a knee of the batter 70. The lead leg 72 is defined as the leg that is the forward positioned leg in a batting stance. The leg coupler 12 is configured to be extendable around the lead leg 72. The leg coupler 12 may include, particularly, a first strap 14 that is formed in a closed loop having an adjustable length. The loop formed by the first strap 14 may be opened or closed with a closure 16 positioned on the first strap 14. A second strap 18 is formed in a closed loop also having an adjustable length. The second strap 18 also includes a closure 20 for opening or closing the loop formed by the second strap 18. As can be seen in the Figures, the first 14 and second 18 straps having mounted on them conventional strap adjusters 22 for adjusting the length of the first 14 and second 18 straps to thereby increase or decrease a diameter of the loops formed by the first 14 and second 18 straps. A plurality of connecting straps 24 extends between the first 14 and second 18 straps. The first strap 14 is positioned vertically above the second strap 18 so that a distance between the first 14 and second 18 straps is between 2.0 inches and 12.0 inches.

A generally conventional baseball bat 26 is provided and includes a grip 28 terminating with a knob 30. The term "baseball bat" is being used to describe any type of bat used for hitting balls and is not limited to those only used for baseballs. Thus other bats, such as softball bats, may also be used with the assembly 10. Moreover, the materials used for the construction of the baseball bat 26 are not limited and may be any conventional material including wood, metals and composite materials.

Figure 2:
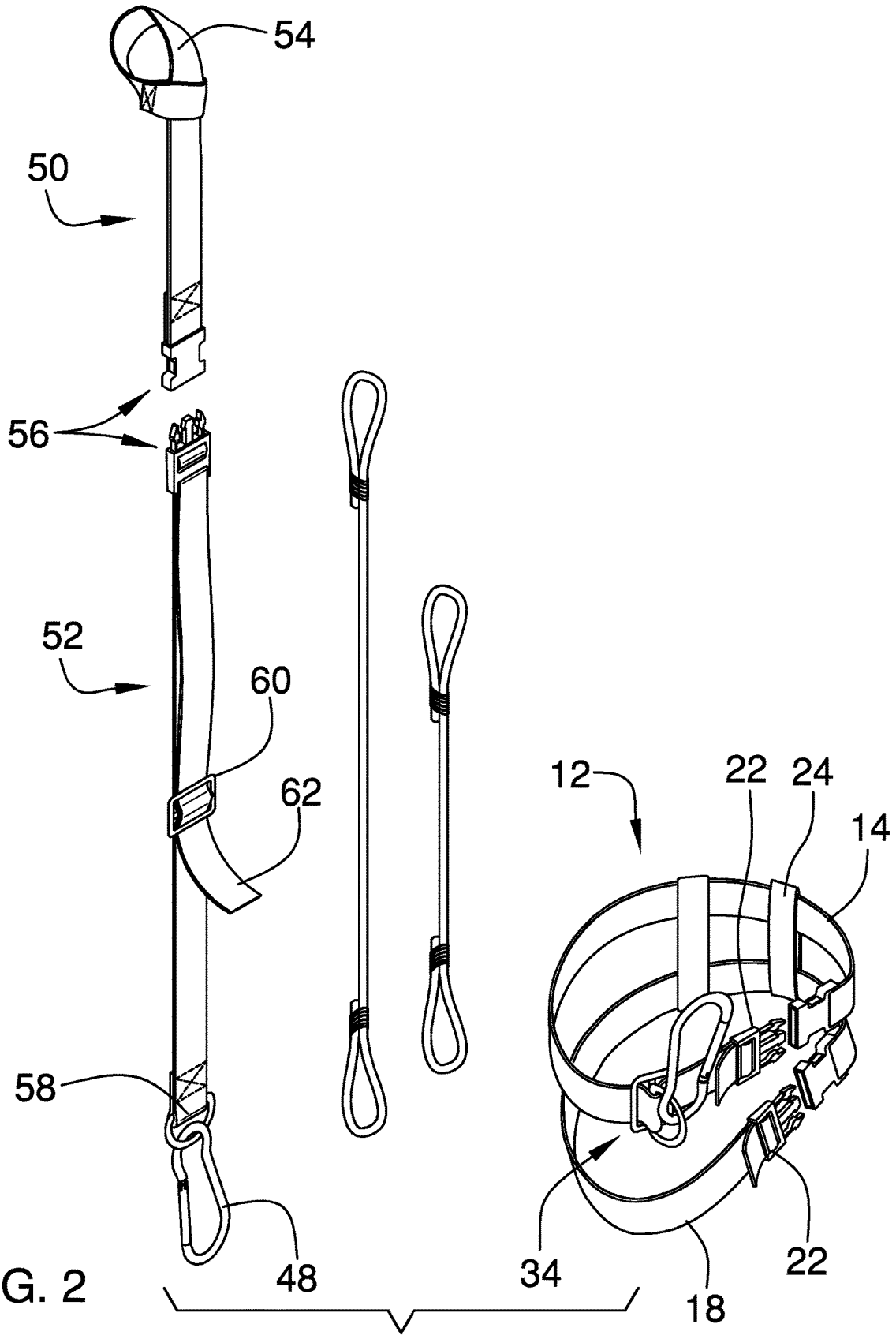
FIG. 2 is an isometric view of an embodiment of the disclosure.
Figure 3:
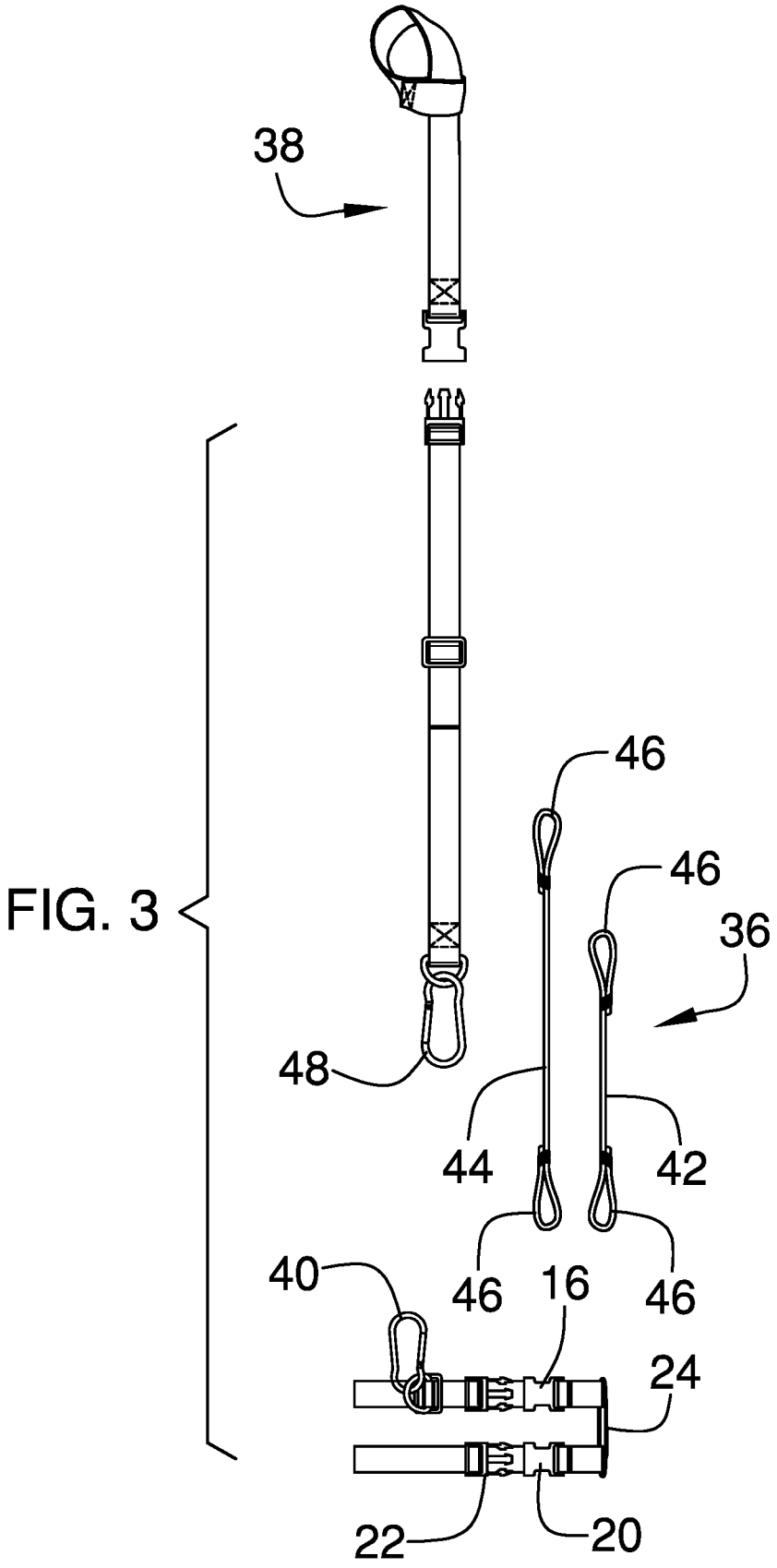
FIG. 3 is a front view of an embodiment of the disclosure.
Figure 4:
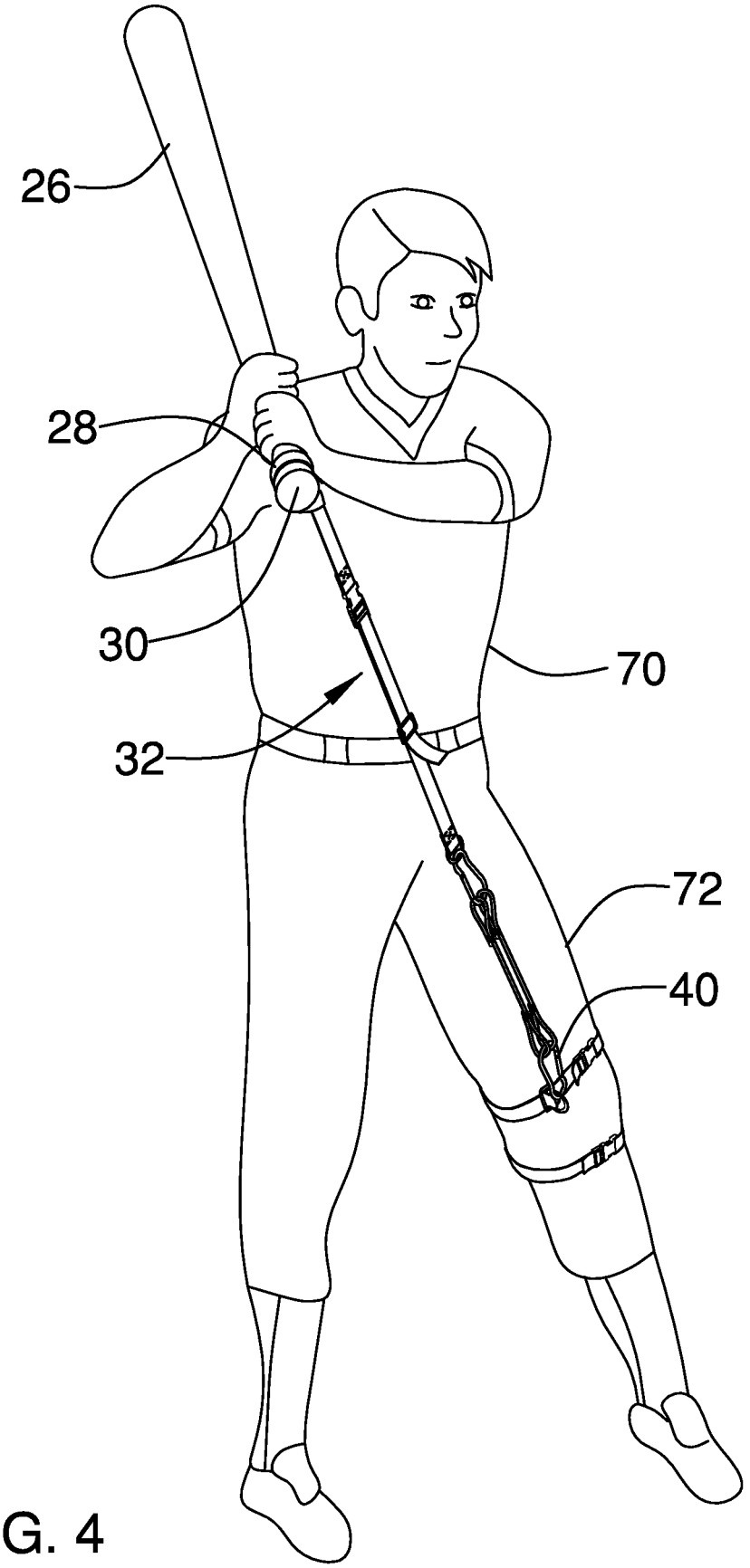
FIG. 4 is an isometric in-use view of an embodiment of the disclosure.
Figure 5:
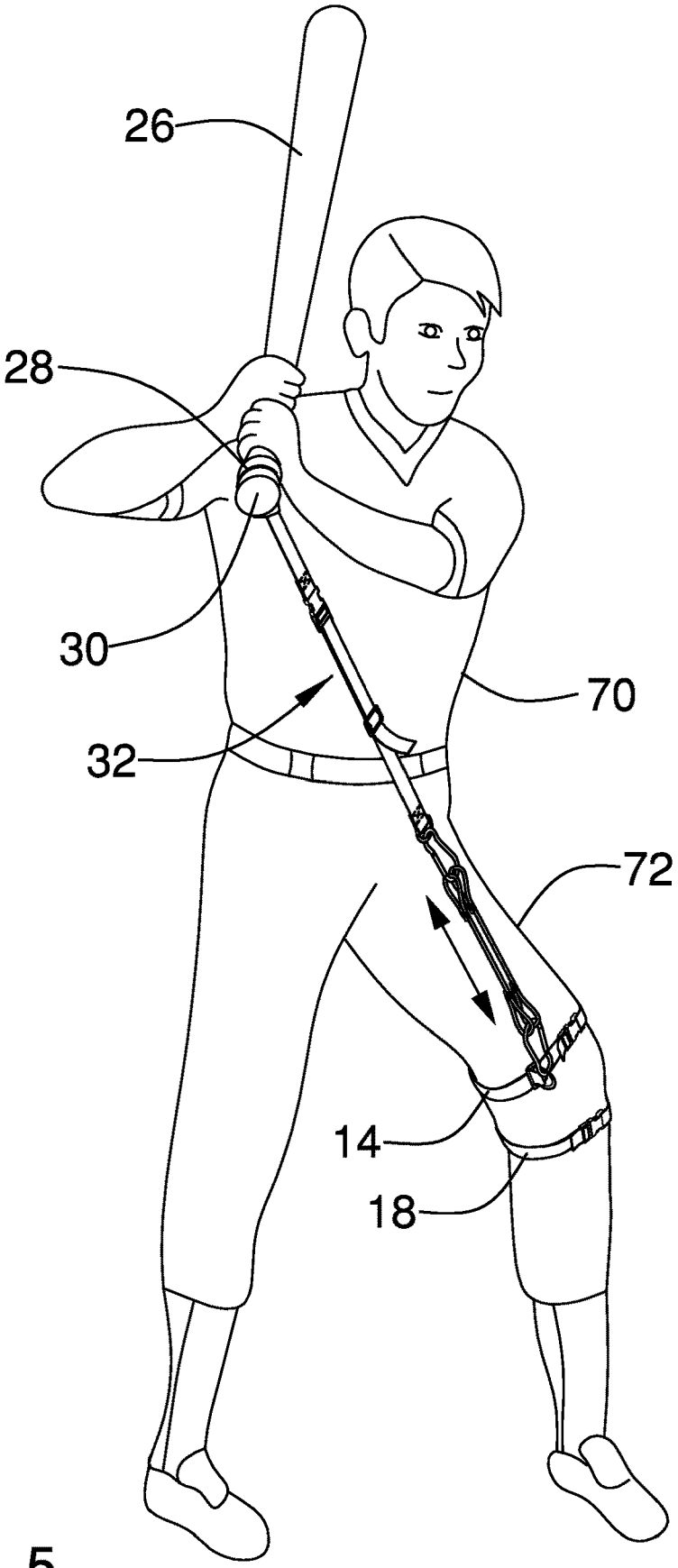
FIG. 5 is an isometric in-use view of an embodiment of the disclosure.

A tether 32 is attached to the baseball bat 26 grip 28 adjacent to the knob 30. The tether 32 is also attached to the leg coupler 12 to releasably secure the baseball bat 26 to the leg coupler 12. An attachment point 34 between the tether 32 and the leg coupler 12 may be movable on the leg coupler 12. As can be seen in FIG. 2, this may be accomplished, for instance, by utilizing a strap slide positioned on the first strap to which is attached a D-ring. The strap slide may then be moved where most comfortable for a user of the assembly 10.

The tether 32 includes a lower portion 36 and an upper portion 38. The lower portion 36 is coupled to the leg coupler 12. Moreover, the lower portion 36 is resiliently stretchable such that its resistance to stretching increases as its length increases. A lower coupler 40 releasably couples the lower portion 36 to the leg coupler 12. The lower coupler 40 may include a clip, such as a carabiner to allow the user to easily swap out one lower portion 36 for another lower portion 36 having a different resistance to stretching and/or length. In one embodiment to achieve the resistance properties desired, the lower portion 36 may comprise a first elastic band 42 and a second elastic band 44. The first 42 and second 44 elastic bands are each comprised of a similar material wherein the first elastic band 42 is shorter than the second elastic band 44, such as for example 4.0 inches and 8.0 inches, respectively. Thus, the first elastic band 42 has a greater resiliency to stretching than the second elastic band 44 when both of the first 42 and second 44 elastic bands are taut. In another embodiment each of the first 42 and second 44 elastic bands has a similar length, but the first elastic band 42 is comprised of a material having more resistance to stretching than the material comprising the second elastic band 44. Each of the first 42 and second 44 bands may have terminal ends 46 formed into loops as shown in FIG. 2 to facilitate disconnection and connection with the leg coupler 12 and upper portion 38. This allows the lower portion 36 to be modified as needed for an intended user of the assembly 10.

The upper portion 38 is removably coupled to the baseball bat 26. The upper portion 38 includes a first section 50 and a second section 52. The first section 50 has an upper end 54 formed into a loop that is extended around the baseball bat 26. As can be seen in the Figures, the upper end 54 may form a slip loop for loosening or tightening around the baseball bat 26. The second section 52 will typically be provided with an adjustable length. A connector 56 releasably couples a lower end of the first section 50 to the second section 52. The connector 56 may include a conventional male and female mating coupler. A securing member 48 releasably couples a bottom end 58 of the second section 52 to the lower portion 36. As can be seen in FIG. 1, the securing member 58 may include a D-ring attached to the second section 52 on which is positioned a carabiner to engage the first 42 and second 44 elastic bands. The upper portion 38 comprises a material that is resistant to stretching and may include any conventional material used for straps or cordage, but may particularly include canvas straps, nylon straps, and the like. Generally, the tether 32 has a length at least equal to 10.0 inches and no greater than 40.0 inches.

The second section 52 may have a slide 60 positioned thereon wherein the second section 52 extends through the connector 56. By adjusting the length from the securing member 48 to connector 56, the length of the second section 52 and thus the entire tether 32 is altered. A loose portion 62 of the second section 52 is then extended through the slide 60 to retain it in place which aids in preventing the second section 52 from sliding through the connector 56.

In use, the tether 32 length is adjusted so that that the tether 32 is taut as the batter is positioned in a set position. The set position is one where the batter 70 is relaxed in the batter's box and has not yet started to move toward a batting swing load position. As the batter 70 moves toward the batting swing load position, the tension on the lower portion 36 increases to give the batter muscle memory feedback. Furthermore, the tension on the tether 32 helps to keep the batter's hands inside throughout the batter's swing. The ability to alter the resilience of the lower portion 36 and the length of the upper portion 38 facilitates tailoring the assembly 10 for all users as well as allowing a same user the ability to adjust the tension experienced during the batting swing load position.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A method of teaching a person a proper batting swing, the method including the steps of:

attaching a leg coupler to a lead leg of a batter adjacent to a knee of the batter, the leg coupler being configured to be extendable around the lead leg;

providing a baseball bat having a grip terminating with a knob;

attaching a tether to the baseball bat grip immediately adjacent to the knob whereby the tether is configured to connect to the baseball bat between the knob and hands of the batter when the baseball bat is held by the batter, the tether being attached to the leg coupler, the tether including a resiliently stretchable area and an area resistant to stretching; and adjusting a length of the tether such that the tether is taut as the batter is positioned in a set position before the batter moves toward a batting swing load position, wherein resistance to stretching of the tether increases as the batter moves to the batting swing load position.

2. The method of teaching a person a proper batting swing according to claim 1, wherein the leg coupler including:

a first strap being formed in a closed loop;

a second strap being formed in a closed loop;

at least one connecting strap extending between the first and second straps such that the first strap being positioned vertically above the second strap.

3. The method of teaching a person a proper batting swing according to claim 2, wherein the leg coupler further comprises:

the closed loop formed by the first strap having an adjustable circumference, the first strap including a closure for opening or closing the closed loop formed by the first strap; and the closed loop formed by the second strap having an adjustable circumference, the second strap including a closure for opening or closing the closed loop formed by the second strap.

4. The method of teaching a person a proper batting swing according to claim 1, wherein an attachment point between the tether and the leg coupler is movable on the leg coupler.

5. The method of teaching a person a proper batting swing according to claim 1, wherein the tether includes:

a lower portion coupled to the leg coupler, the lower portion being resiliently stretchable;

an upper portion coupled to the baseball bat, the upper portion having an adjustable length and being comprised of a material resistant to stretching.

6. The method of teaching a person a proper batting swing according to claim 5, wherein the tether further includes the upper portion including a first section and a second section, the first section having an upper end forming a loop being extended around the bat, the second section having an adjustable length, a connector releasably coupling a lower end of the first section to the second section, a securing member releasably coupling a bottom end of the second section to the lower portion.

7. The method of teaching a person a proper batting swing according to claim 6, wherein the tether has a length at least equal to 20.0 inches and no greater than 40.0 inches.

8. A method of teaching a person a proper batting swing, the method including the steps of:

attaching a leg coupler to a lead leg of a batter adjacent to a knee of the batter, the leg coupler being configured to be extendable around the lead leg, the leg coupler including:

a first strap being formed in a closed loop having an adjustable length, the first strap including a closure for opening or closing the closed loop formed by the first strap;

a second strap being formed in a closed loop having an adjustable length, the second strap including a closure for opening or closing the closed loop formed by the second strap;

a plurality of connecting straps extending between the first and second straps, the first strap being positioned vertically above the second strap, a distance between the first and second straps being between 2.0 inches and 12.0 inches;

providing a baseball bat having a grip terminating with a knob;

attaching a tether to the baseball bat grip immediately adjacent to the knob whereby the tether is configured to connect to the baseball bat between the knob and hands of the batter when the baseball bat is held by the batter, the tether being attached to the leg coupler, an attachment point between the tether and the leg coupler being movable on the leg coupler, the tether including:

a lower portion coupled to the leg coupler, the lower portion being resiliently stretchable, the lower portion comprising a first elastic band and a second elastic band, a lower coupler releasably coupling the lower portion to the leg coupler, the first elastic band having a greater resiliency to stretching than the second elastic band when both of the first and second elastic bands are taut;

an upper portion coupled to the baseball bat, the upper portion including a first section and a second section, the first section having an upper end forming a loop being extended around the bat, the second section having an adjustable length, a connector releasably coupling a lower end of the first section to the second section, a securing member releasably coupling a bottom end of the second section to the lower portion, the upper portion comprising a material being resistant to stretching;

the tether having a length at least equal to 10.0 inches and no greater than 40.0 inches; and adjusting a length of the tether such that the tether is taut as the batter is positioned in a set position before the batter moves toward a batting swing load position, wherein resistance to stretching of the tether increases as the batter moves to the batting swing load position.

* * * * *